US005649398A

United States Patent [19]

Isley, Jr. et al.

[11] Patent Number: 5,649,398

[45] Date of Patent: Jul. 22, 1997

[54] HIGH STRENGTH FABRIC REINFORCED WALLS

[75] Inventors: Frederick P. Isley, Jr., Tracy; Edward R. Fyfe, Del Mar; John D. Neuner, Bay Point, all of Calif.

[73] Assignee: Hexcel-Fyfe L.L.C., Del Mar, Calif.

[21] Appl. No.: 258,434

[22] Filed: Jun. 10, 1994

[51] Int. Cl.[6] ..... E04C 5/07

[52] U.S. Cl. ..... 52/309.17; 52/309.13; 52/514.5; 52/741.3; 52/DIG. 7; 24/304

[58] Field of Search ..... 52/309.17, 309.13, 52/612, 514, 514.5, 741.3, DIG. 7, 597; 24/304, 459; 156/250, 291, 293; 428/15

[56] References Cited

U.S. PATENT DOCUMENTS

| | | | |
|---|---|---|---|
| 2,752,275 | 6/1956 | Raskin et al. | 52/DIG. 7 X |
| 2,836,529 | 5/1958 | Morris | 52/DIG. 7 X |
| 3,044,919 | 7/1962 | Stoneburner | 52/DIG. 7 X |
| 3,145,502 | 8/1964 | Rubenstein | 52/309.17 X |
| 3,304,115 | 2/1967 | Rubenstein . | |
| 4,218,496 | 8/1980 | Savignac | 52/309.17 X |
| 4,392,335 | 7/1983 | Heiman | 52/309.17 |
| 4,668,548 | 5/1987 | Lankard | 52/514 X |
| 4,786,341 | 11/1988 | Kobatake et al. . | |
| 4,918,883 | 4/1990 | Owen et al. . | |
| 5,043,033 | 8/1991 | Fyfe . | |
| 5,218,810 | 6/1993 | Isley, Jr. . | |

*Primary Examiner*—Christopher Todd Kent
*Attorney, Agent, or Firm*—Oppenheimer Poms Smith

[57] ABSTRACT

A method is provided for reinforcing the face or faces of walls so as to prevent or reduce the likelihood of failure when such walls are subjected to atypical loadings such as are encountered during earthquakes. The method includes the step of applying a resin-impregnated fabric layer over a portion of an exposed face of a wall to be reinforced. The method includes the further step of anchoring the resin-impregnated fabric layer to a structural member of the wall using fabric fasteners, adhesives, or a combination thereof.

20 Claims, 5 Drawing Sheets

Fig. 5.
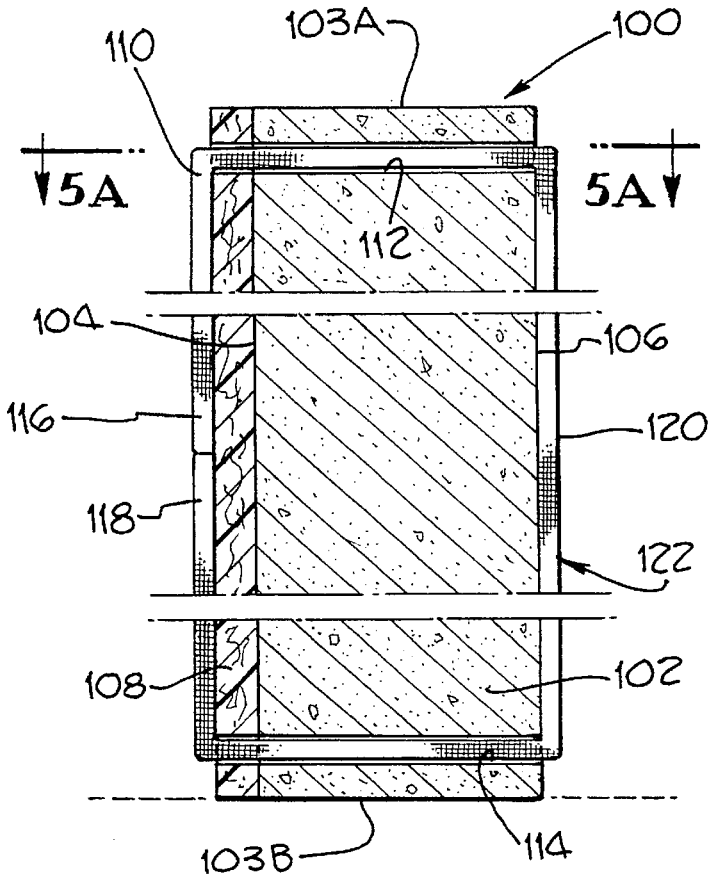
Fig. 4.
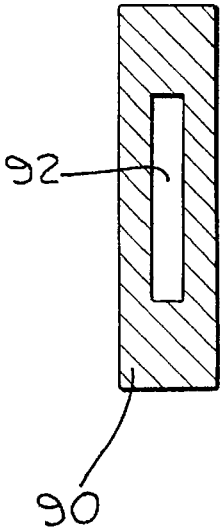
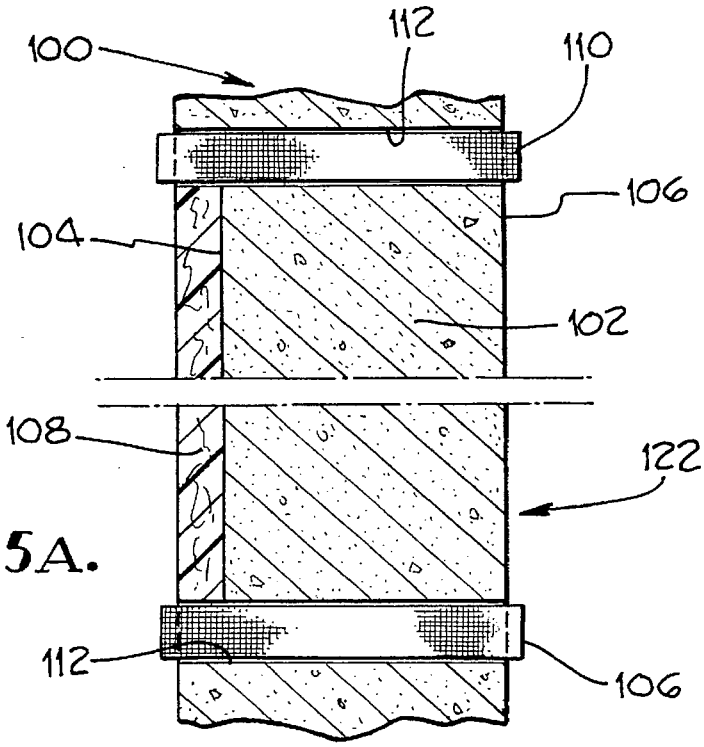
Fig. 5A.

HIGH STRENGTH FABRIC REINFORCED WALLS

BACKGROUND OF THE INVENTION

1. Field of the Invention

The present invention relates generally to reinforcing walls to increase their ability to withstand atypical loads such as those encountered during earthquakes. More particularly, the present invention relates to a method for increasing the ductility and strength of a wall in situ without removing the wall from service and without the need to provide auxiliary support during the repair process.

2. Description of the Related Art

Recent earthquakes have revealed that many existing walls lack sufficient strength and ductility to withstand moderate to severe earthquakes. Moderate quakes have caused all types of load-bearing and non-load bearing walls to crack while stronger quakes at times have resulted in the total failure of such walls.

Because the collapse of walls can have disastrous consequences, it has become a common practice in the construction of certain walls, e.g., cellular brick or concrete walls, to reinforce the walls with metal rods or bars. However, there are hundreds of thousands of existing in earthquake-prone areas which do not have adequate metal reinforcement and which were not designed to withstand high degrees of atypical loading. Furthermore, while metal reinforcement provides added structural strength to walls, metal-reinforced walls also have been known to crack or fail when subjected to atypical loadings generated during earthquakes.

In most cases, the replacement of existing walls with walls having greater strength and ductility is economically impracticable. Accordingly, there is a need to provide a simple, efficient and relatively inexpensive method for reinforcing walls so as to prevent or reduce the likelihood of failure during an earthquake. One example of a method for increasing the structural strength of existing structures without their removal from service is set forth in U.S. Pat. No. 5,043,033, issued to Fyfe. In this particular patent, the surface of a concrete column is wrapped with a composite material to form a hard annular shell surrounding the concrete column. The space between the outer composite shell and the concrete column is then pressurized by injecting a hardenable liquid.

Another approach to reinforcing the exterior of an existing concrete support column without removing it from service is set forth in U.S. Pat. No. 5,218,810, issued to Isley, Jr. In this patent, the exterior surface of a concrete column is wrapped with a composite material to form a hard annular shell or sleeve which is in direct contact with the column surface.

While these approaches may be well suited to the reinforcement of existing structures which can be completely surrounded by a composite shell, i.e., columns, they do not account for the problems associated with reinforcing certain structures, i.e., walls, wherein it is structurally or economically infeasible or impracticable to form a unitary composite shell about the exterior of the structure.

For instance, a unitary composite shell cannot be formed around the portions of exterior or interior walls which include windows, doors, or other structural discontinuities provided for the ingress or egress of light, air, or people. Accordingly, there remains a need for a fast, efficient, and cost-effective way to reinforce walls so as to increase their resistance to structural failure during earthquakes.

SUMMARY OF THE INVENTION

In accordance with the present invention, a simple, fast, efficient and cost-effective method is provided for reinforcing the face or faces of walls so as to prevent or reduce the likelihood of failure when such walls are subjected to atypical loadings such as are encountered during earthquakes.

The present invention is based upon the discovery that the resistance of walls to structural failure can be increased by applying at least one fabric layer impregnated with resin over the exposed face or faces of such walls.

The present invention is based on the further discovery that a wall which includes an overlying composite reinforcement layer is less likely to fail if the composite reinforcement layer is attached or otherwise anchored to a structural member of the underlying wall.

The method of the present invention can be used to reinforce different wall types including single component walls such as concrete slab type walls, multi-component walls such as brick walls, and studded or other walls which are provided with an overlying facia.

As a feature of the present invention, at least one resin-impregnated fabric layer is applied over a portion of an exposed face of the wall to form a composite reinforcement layer.

As an additional feature of the present invention, means are provided for anchoring the composite reinforcement layer to the wall. The anchoring means to be provided may vary greatly depending a variety of factors including the type of wall to be reinforced, the costs associated with different methods for anchoring the composite reinforcement layer to the wall, and aesthetic concerns relating to the appearance of the wall to be reinforced.

For concrete slab walls, brick walls and other walls wherein the exposed face of the wall comprises a portion of the wall structural member, as a feature of the present invention, the composite reinforcement layer is anchored to the wall using an adhesive resin or other adhesive product.

For walls including an overlying facie which is provided principally for reasons other than added structural strength, as an alternative feature of the present invention, the composite reinforcement layer is anchored to an underlying structural member using a fastener which extends through the face of the wall into, through or around the structural member.

As yet additional feature of the present invention, the fastener is formed from a fabric member which is partially or totally impregnated with resin.

As another feature of the present invention, the fastener is formed from a fabric member which is partially or totally impregnated with an adhesive.

As yet one more feature of the present invention, an anchor retention device such as pin or plug is provided which cooperates with the fabric member to anchor the composite reinforcement layer to the structural member.

As another feature of the present invention, at least one resin-impregnated fabric layer includes a pair of horizontally extending selvedges.

As an alternative or additional feature of the present invention, at least one resin-impregnated fabric layer includes a pair of vertically extending selvedges.

As yet another feature of the present invention, the composite reinforcement layer includes a plurality of high strength, substantially horizontally extending warp yarns and a plurality of lower strength, higher elongation, substantially vertically extending fill yarns.

As yet an additional feature of the present invention, the high strength warp yarns are selected from the group of materials including glass, polyaramid, graphite, silica, quartz, carbon, ceramic, polyethylene, polyimide, liquid crystal polymers and polypropylene and the lower strength high elongation fill yarns are selected from the group of materials including polyester and nylon.

As an additional or alternative feature of the present invention, at least one resin-impregnated fabric layer includes a plurality of plus bias angle yarns which extend at an angle between zero and ninety degrees relative to the selvedges and a plurality of minus bias angle yarns which extend at an angle of between minus zero to minus ninety degrees relative to the selvedges.

As yet an additional feature of the present invention, the resin in the composite reinforcement layer is impregnated with an intumescent or a low temperature melting glass suitable for rendering the composite reinforcement layer fire resistant.

As yet one more feature of the present invention, a hardenable low shrink material is injected between the composite reinforcement layer and the wall face so as to provided further reinforcement for the wall.

The above-discussed features and many other features and attendant advantages of the present invention will become better understood by reference to the following detailed description when taken in conjunction with the accompanying drawings.

BRIEF DESCRIPTION OF THE DRAWINGS

FIG. 4 is a plan section of the pin shown in FIG. 3.

FIG. 5 is a side section of an exemplary preferred reinforced wall showing a third preferred exemplary anchor.

FIG. 5A is a partial plan section of the exemplary preferred reinforced wall of FIG. 5 taken in the direction of arrows 5A—5A.

DETAILED DESCRIPTION OF THE PREFERRED EMBODIMENTS

The present invention may be used to reinforce a wide variety of walls. The invention is especially well-suited for reinforcing walls wherein it is structurally infeasible or economically impracticable tow rap the wall face with a composite reinforcement layer so as to form a unitary composite shell around the wall.

Figure 1:
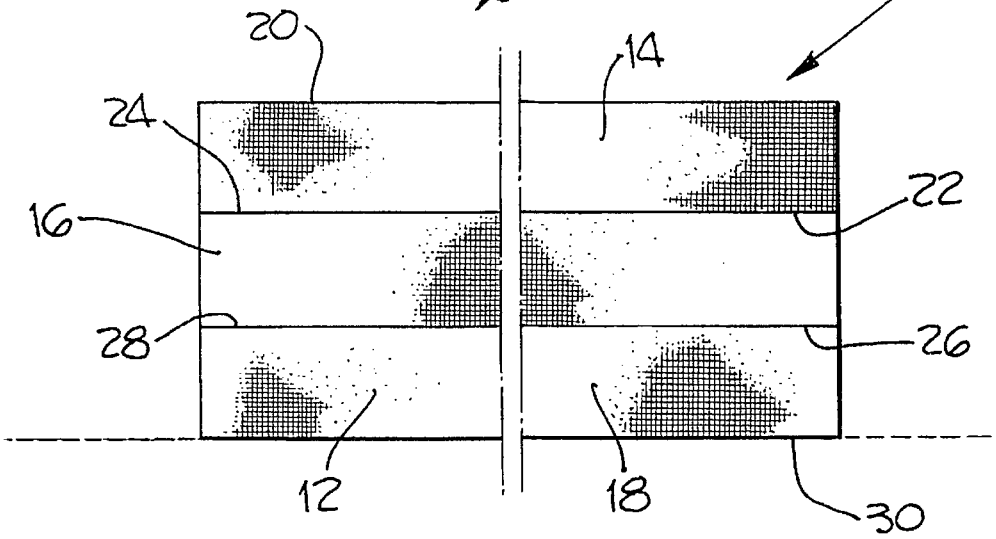
FIG. 1 shows the face of an exemplary preferred reinforced wall in accordance with the present invention.

A preferred exemplary reinforced wall in accordance with the present invention is shown generally at 10 in FIGS. 1. The face (not shown) of the underlying wall is completely covered by a composite reinforcement layer which is shown generally at 12. Composite reinforcement layer 12 is made up of three fabric layers 14, 16 and 18. Each of the fabric layers 14 through 18 has first and second parallel selvedges which, preferably, extend substantially horizontally as shown in FIG. 1. The first and second selvedges for fabric layer 14 are shown at 20 and 22. The first and second selvedges for fabric layer 16 are shown at 24 and 26, respectively. The first and second selvedges for fabric layer 18 are shown at 28 and 30, respectively.

As stated above, the method of anchoring the composite reinforcement layer to the underlying wall may vary greatly depending a variety of factors including the type of wall to be reinforced, the costs associated with different methods for anchoring the composite reinforcement layer to the wall, and aesthetic concerns relating to the appearance of the wall to be reinforced.

Figure 2:
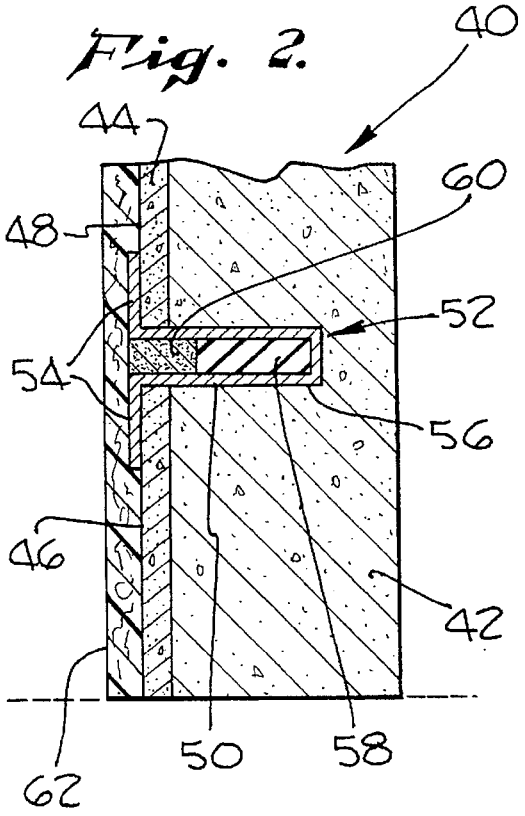
FIG. 2 is a partial side section of an exemplary preferred reinforced wall in accordance with the present invention showing a first preferred exemplary anchor.

Referring now to FIG. 2, a partial side section of a first exemplary preferred reinforced wall 40 is shown. Reinforced wall 40 includes a thick concrete slab structural member 42, a relatively thin outer layer or facia 44, face 46, and composite reinforcement layer 48. The reinforced wall 40 also includes a plurality of fabric fasteners or anchors 50 (only one which is shown) and corresponding anchor receiving cavities 52 (also only one of which is shown).

The reinforced wall 40 of FIG. 2 is formed by drilling holes through facia 44 and into the structural member 42 so as to define anchor receiving cavities 52. Anchor receiving cavities 52 are provided with sufficient depth to receive and hold fabric fasteners 50. Cavities 52 are distributed about the portion of face 20 to be reinforced so as to facilitate the anchoring of the edges and selected intermediate portions of each fabric layer comprising composite reinforcement layer 48. It is preferred that adjacent anchors be spaced evenly about the wall face at a density of between about 0.1 and 2.0 anchors per square foot. However, those skilled in the art will understand that the preferred distribution and density of anchors will vary depending on many factors including the thickness and density of the composite reinforcement layers, the strength of adhesive, if any, binding the composite reinforcement layer 48 to face 46, and the desired properties of the wall to be reinforced.

Fabric fasteners 50 are preferably configured as sleeves or strips to be inserted into cavities 52. Fabric fasteners 50 include engagement portions 54 which, in the preferred embodiment shown in FIG. 2, adjoin face 46 and composite reinforcement layer 48. Each fabric fastener 50 also includes an anchored portion 56 which extends into a cavity 52 and adjoins structural member 42.

After cavities 52 are formed, fabric fasteners 50 are partially inserted into cavities 52 so as to seat anchored portions 56 within cavities 52 against structural member 42. The anchored portions 56 are preferably impregnated with an adhesive resin or other adhesive product. Once the resin-impregnated anchored portions 56 are positioned within cavities 52, a plug 58 is used to wedge the anchored portion 56 of each fabric fastener 50 into engagement with structural member 42. Plug 58 is preferably formed from an elastomeric substance, e.g., rubber, which is compatible with the resin or other material in which anchored portions 56 are impregnated. The space between the plug 58 and composite reinforcement layer 48 can be filled with a suitable filler 60 such as resin, putty or a spackling compound.

While the use of an in situ plug in the anchoring system shown in FIG. 2 is generally preferred, the anchoring of anchored portions 56 may be accomplished without the use of an in situ plug by impregnating the anchored portions 56 with a resin which will adhere to the structural member 42 upon curing.

Alternatively, the anchored portions 56 may be impregnated with a hot melt adhesive or another suitable adhesive. Impregnation of the anchored portions 56 in a hot melt adhesive may be accomplished using a hot melt glue gun. Alternatively, a pre-formed hot melt plug can be used instead of rubber plug 58 to seat anchored portions 56 in cavities 52 in which case the hot melt adhesive is melted in place by injecting hot air into cavities 52 or using other suitable means. Anchored portions 56 may also be pre-impregnated with a hardened hot melt adhesive which is heated after the anchored portions 56 are seated within cavities 52.

After anchored portions 56 are seated within cavities 52, the fibers which extend outward from face 46 are partially or totally separated and then wet out with the preferred resin (if not wetted out already) to form engagement portions 54 and fanned out against face 46 of facia 44 as best shown in FIG. 2. Alternatively, fabric members 22 can be attached to face 46 or outer surface 62 using a hot melt or other suitable adhesive. (Where the fabric members are attached directly to the fabric layer using a hot melt adhesive, it is preferable to melt the adhesive and allow it set up before impregnating the fabric layer with resin).

Thereafter, one or more fabric layers comprising composite reinforcement layer 48 are applied to face 46 preferably but not necessarily with the selvedges extending substantially horizontally in the manner shown in FIG. 1.

In an alternative preferred method (not shown) for anchoring composite reinforcement layer 48 to structural member 42, the fabric layers of composite reinforcement layer 48 are provided with apertures corresponding to anchor receiving cavities 52. Upon placing the fabric layers in the desired positions against face 46, engagement portions 54 are drawn through the apertures and fanned out against the exposed outer surface 62 of composite reinforcement layer 48.

Each fabric layer of a composite reinforcement layer 48 must be impregnated with resin in order for composite reinforcement layer 48 to function properly in accordance with the present invention. It is generally preferable to impregnate the fabric layers with resin prior to application to face 46 of the wall 40. However, if desired, the resin may be impregnated into the fabric layers after the fabric layers are laid against face 46.

Suitable resins for impregnating the fabric layers and the fabric members in accordance with the present invention include polyester, epoxy, vinylester, acrylic, modified acrylic, urethane, phenolic, polyimide, bismaleimide, urethane, polyurea, or combinations thereof, with epoxy being a preferred resin. Other impregnating resins may be utilized provided that they have the same degree of strength and toughness provided by the previously listed resins. In most applications, thermoset resins are preferred. However, enhancements to process will allow the use of thermoplastic resin systems.

It is often desirable though not necessary to coat the portion of wall 40 to be reinforced with a preferred resin before application of the resin-impregnated fabric layers to the wall. If the wall surface is porous, it may be desirable to allow the resin to penetrate the wall surface before applying the resin-impregnated fabric layers to the wall.

If the face of the wall is uneven or irregular or extra adhesion is desired, vacuum bagging techniques well known in the arts can be used to draw the fabric layers towards the wall face to enhance conformability to the wall surface and to remove air which might be trapped therebetween.

It is preferred that the exterior face be thoroughly cleaned prior to application of the impregnated fabric layers. The exterior face should be sufficiently clean so that the resin matrix will adhere to the face of the wall. While bonding of the resin matrix and the composite reinforcement layer to face 46 is preferred, it is not essential since the composite reinforcement layer 48 is anchored to the structural member 42.

Curing of the resins is carried out in accordance with well known procedures which will vary depending on the particular resin matrix used. Various conventional catalysts, curing agents and additives which are typically employed with such resin systems may be used.

Once the resin is cured, the combination of the fabric layers, the fabric members, and the cured resin form an integral high strength composite which is permanently bonded (and thus anchored) to structural member 42. Advantageously, the resin-impregnated fabric members in the above describe wall are almost invisible and thus the foregoing method is useful when aesthetic considerations are important.

If desired, the exposed surface of the composite reinforcement layer may be coated with a desired surface protectant, e.g., paint, urethane, acrylic, etc. In applications where it is preferable that the composite reinforcement layer be resistant to fire, a commercially available coating such as FIREGUARD may be used. Alternatively, the resin in the composite reinforcement layer may be impregnated with an intumescent or a low temperature melting glass suitable for rendering the composite reinforcement layer fire resistant. The melting glass preferably has a melting temperature of no more than about 800 degrees fahrenheit.

If the structure to be reinforced is a historical landmark, it may be necessary to allow the face of the structure to show through the composite reinforcement layer. In such case, the preferred fabric layers should be comprised of a material that is or becomes transparent upon curing of the preferred resin. Fabrics suitable for such purposes include E-glass woven, adhesively bonded, unidirectionals and some stitch-bonded unidirectionals with woven fabrics being preferred.

Resins suitable for such purposes include aliphatic epoxy, in combination with linear amine cross linking agents, acrylic, modified polyester and polyurethanes. Other additives such as flow controllers (thixoprops), ultraviolet inhibitors or stabilizers, flexibilizers, etc., may also be required.

If the composite reinforcement layer in such applications is to be coated, it is preferable to use a transparent urethane or acrylic, or other "water white" transparent materials with similar properties.

Figure 3:
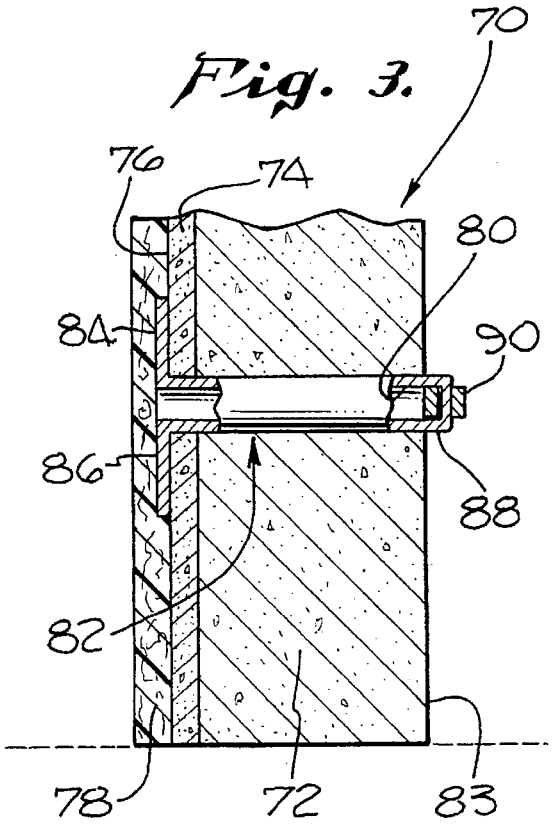
FIG. 3 is a partial side section of an exemplary preferred reinforced wall in accordance with the present invention showing a second preferred exemplary anchor including a substantially inflexible pin.

Referring now to FIG. 3, a partial side section of a second exemplary preferred reinforced wall 70 is shown. Reinforced wall 70 includes a plurality of relatively thin stud-type structural members 72 (only one is shown), an outer layer or facia 74, face 76, and composite reinforcement layer 78. The reinforced wall 70 includes a plurality of fabric fasteners or anchors 80 (only one which is shown) and corresponding anchor receiving cavities 82 (also only one of which is shown).

The reinforced wall 70 of FIG. 3 is formed by drilling holes through facia 74 and into selected studs 72 so as to define anchor receiving cavities 82. In contrast to the anchor receiving cavities of FIG. 2, cavities 82 extend through structural members 72 to the obverse side 83 of wall 70.

Fabric fasteners 80 include engagement portions 84 and 86 which adjoin face 76 and composite reinforcement layer 78. Each fabric fastener 80 also includes an anchored portion 88 which extends through cavity 82 to the obverse side 83 of wall 70. Anchored portion 88 is anchored to stud 72 using a locking pin 90. Locking pin 90, as best shown in FIG. 4, is preferably formed from a stiff bar or rod having an aperture 92 for receiving fabric fastener 80. As is shown in FIG. 3, the fabric fastener 80 is looped through aperture 92 after which the engagement portions 84 and 86 are pulled tight so as to wedge the locking pin 90 against the obverse side 83 of stud 72. The engagement portions 84 and 86 of the fabric fastener 80 are then extended through anchor receiving cavity 82 and fanned out across the front face 76 of the wall in the manner described above.

As with the embodiment of FIG. 2, the fabric fasteners 80 of FIG. 3 are distributed about the wall to be reinforced so as to facilitate the anchoring of the edges and selected intermediate portions of each fabric layer comprising composite reinforcement layer. Those skilled in the art will understand that the preferred distribution and density of anchors will vary depending on the factors discussed above and the spacing of the studs forming the underlying structural member.

A third preferred exemplary wall is shown generally at 100 in FIGS. 5 and 5A. Reinforced wall 100 includes a structural member 102 having upper and lower edges 103A and 103B, faces 104 and 106, and a composite reinforcement layer 108 which completely covers face 104. The reinforced wall 100 also includes a plurality of substantially elongate fabric straps 110. Fabric straps 110 include engagement portions 116 and 118 which adjoin face 104 and composite reinforcement layer 108. Each fabric strap 110 also includes an anchored portions 120 which adjoins face 106 on the obverse side 122 of wall 100.

As is shown in FIGS. 5 and 5A, each fabric strap 110 is passed through a corresponding pair of spaced apart anchor receiving cavities 112 and 114 after which the engagement portions 116 and 118 are pulled tight so as to wedge the anchored portion 120 against the obverse face 106 of wall 102. The engagement portions of the fabric strap 110 are then attached to face 106 or composite reinforcement layer 108 as described above. In applications where obverse side 122 of wall 100 is faced off with a facia, the anchored portion 120 of each fabric strap 110 can be drawn against the exposed surface of such facie to effect the same anchoring function.

Preferably, anchor receiving cavities 112 and 114 are positioned relative to the composite reinforcement layer such that each fabric strap 110 overlays a portion of the composite reinforcement layer extending between opposing parametrial edges of the composite reinforcement layer.

The fabric straps (and the other fabric members described above) may be formed from a suitable fabric including woven or non-woven fabrics and unidirectional tapes. However, the fabric straps are preferably formed from a woven fabric. It is preferred that fabric straps 110 be spaced evenly about the wall face at distances of between about three to six feet. However, as discussed above, those skilled in the art will understand that the preferred distribution of anchors will vary depending on many factors.

The fibers forming the fabric straps are preferably made from the group of materials including glass, polyaramid, graphite, silica, quartz, carbon, ceramic, polyethylene, polyimide, liquid crystal polymers and polypropylene. The fibers forming the fabric members shown in FIGS. 2–3 are preferably made from the group of materials including glass, polyaramid, graphite, silica, quartz, carbon, ceramic, polyethylene, polyimide, liquid crystal polymers and polypropylene, but may also be from the group of materials including polyester and nylon.

In applications such as shown in FIG. 4 where a composite reinforcement layer is placed in direct contact with the exposed face of a structural member, an alternative method for anchoring a composite reinforcement layer to the structural (not shown) involves the use of an adhesive fastener such as an epoxy resin or another suitable resin listed above. The adhesive fastener is applied to the face of the structural member to be reinforced and allowed to gel in the manner describe above. Thereafter, resin-impregnated fabric layers are applied to the face and allowed to cure so as to form a composite reinforcement layer anchored to the underlying structural member as described above.

It should be noted that a "structural member", for purposes herein, includes structural members and any wall member attached or otherwise anchored to a structural member in such a manner as to enable a composite reinforcement layer which is anchored to such wall member to cooperate with such structural member in a manner substantially equivalent to the manner in which the composite reinforcement layer would cooperate with the structural member if anchored directly thereto.

It should also be noted that facias, while typically provided for reasons other than added structural strength, may constitute a structural member. Whether a facia constitutes a structural member will depend upon the mode of attachment of the facia, if any, to the underlying structural member.

Figure 6:
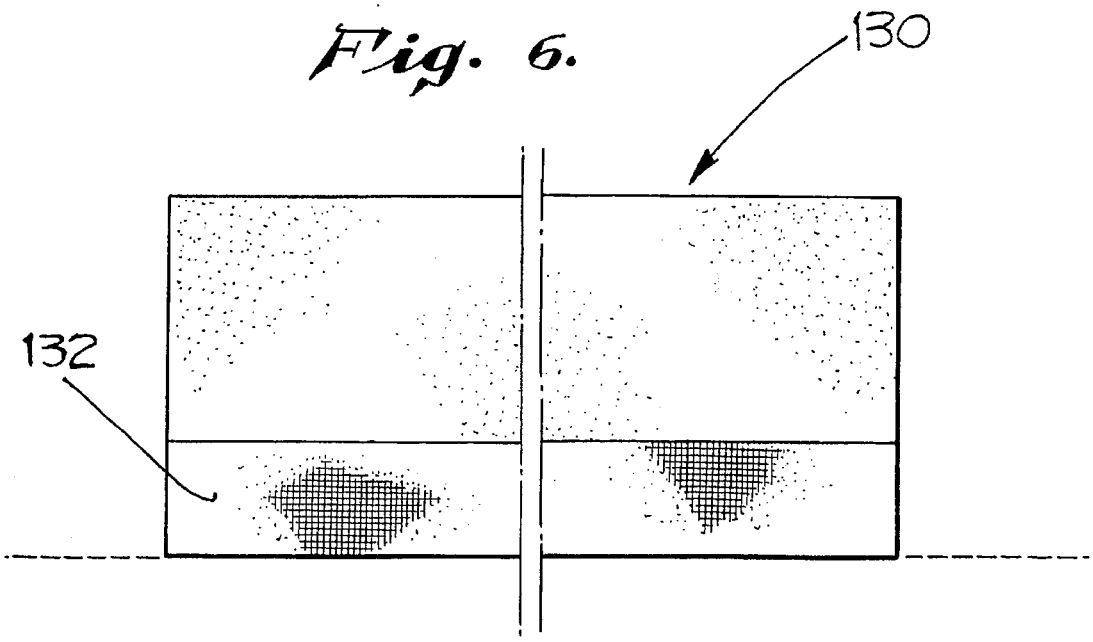
FIG. 6 shows the face of an alternative exemplary preferred reinforced wall wherein the fabric layer only covers a portion of the subject wall.

It is preferred that the fabric layers of a composite reinforcement layer be placed on the exterior face or faces of a wall so that substantially the entire face or faces are covered. However, in certain applications, it may be desirable only to cover those portions of a wall which are most likely to fail during atypical loading, e.g., the lower third of a wall. The partial reinforcement of a wall 130 is shown in FIG. 6. Only the lower third of the face (not shown) of the underlying wall 130 is covered with a composite reinforcement layer shown generally at 132.

Figure 7:
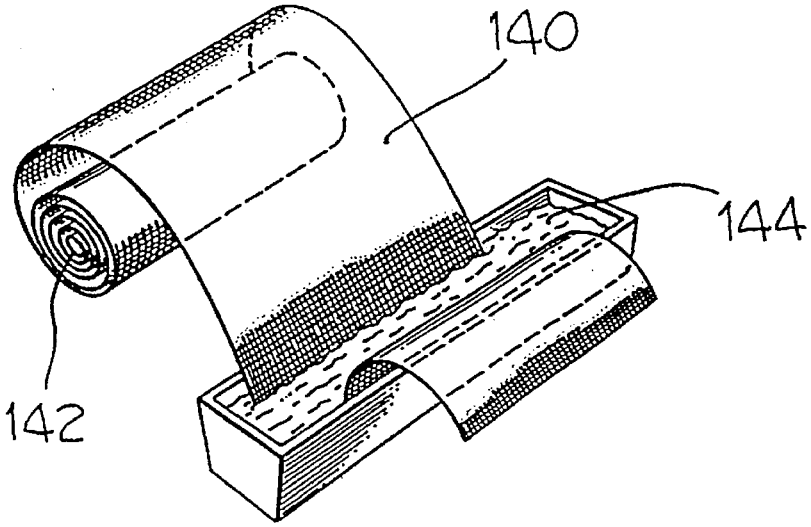
FIG. 7 is a demonstrative representation depicting the impregnation of a fabric layer prior to application to the face of a wall.

Referring now to FIG. 7, a fabric 140 is shown being unwound from a roll 142 and dipped in resin 144 for impregnation prior to application to the face of a wall. Once a sufficient length of fabric 140 has been impregnated within the resin 144, the impregnated fabric layer is cut from the roll 142 and is applied to the face of the wall. The length of the impregnated fabric is chosen so as to cover those portions of the wall which are most likely to fail during atypical loading. Once in place, the resin impregnated fabric layer is allowed to cure to form the composite reinforcement layer. The impregnation and application process is repeated until the selected portion of the wall has been covered as shown in FIG. 1 or 6.

Figure 8:
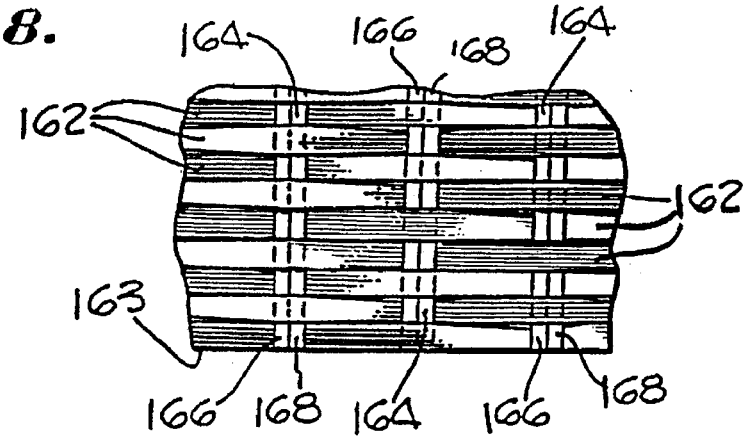
FIG. 8 is a detailed sectional view of a preferred exemplary fabric layer in accordance with the present invention.

A preferred exemplary fabric layer is shown in FIG. 8. The width of the fabric between the selvedges may be from 3 to 100 inches. The fabric has warp yarns 162 and fill yarns 164. The warp yarns extend substantially parallel to the selvedges, with the fill yarns extending substantially horizontally to the selvedges. The fabric is preferably a plain woven fabric but may also be a 2 to 8 harness satin or twill weave. This fabric configuration provides reinforcement in both the warp and fill directions.

Figure 9:
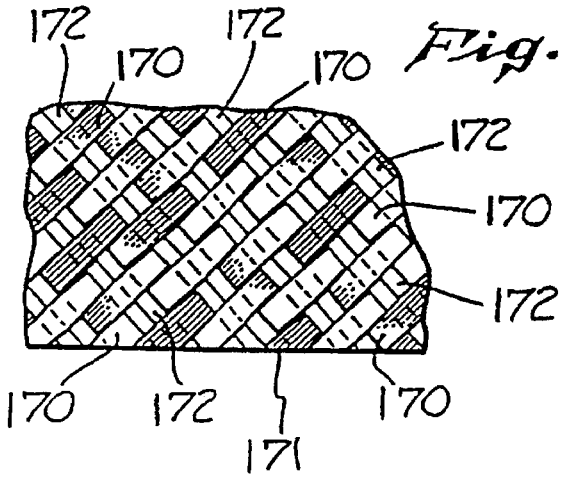
FIG. 9 is a detailed sectional view of an alternative preferred exemplary fabric layer in accordance with the present invention.

A preferred alternate fabric pattern is shown in FIG. 9. In this fabric pattern, plus bias angle yarns 170 extend at an angle of between 0 and 90 degrees relative to the selvedge 171 of the fabric. The preferred angle for the plus and minus bias angle yarns is plus and minus 45 degrees relative to the selvedge 171. The plus bias angle yarns 170 are preferably made from the same yarn material as described in connection with the fabric shown in FIG. 8. The minus bias angle yarns 172 extend at an angle of between 0 and minus 90 degrees relative to selvedge 171. The minus bias angle yarns preferably extend substantially perpendicular to the plus bias angle yarns. Preferably, the plus and minus bias angle yarns are made from the same yarn material. The number of yarns per inch for both the plus and minus bias angles is preferably between about 5 and 30, with about 10 yarns per inch being particularly preferred. Where it is desirable to increase the wall's resistance to shear failure, the preferred angle for the plus and minus bias angle yarns is plus and minus 45 degrees relative to the selvedge 171 (provided the fabric is positioned over the wall such that selvedge 171 extends substantially horizontally or substantially vertically.

The fibers forming the warp and fill yarns for the fabric shown in FIG. 8 (and any other fabric layers described herein) may be made from a wide of materials including glass, polyaramid, graphite, silica, quartz, carbon, ceramic, polyethylene, polyimide, liquid crystal polymers or polypropylene. However, it is believed that the use of high strength, horizontally extending yarns in conjunction with lower strength, higher elongation, vertically extending yarns increases the ductility and strength of a wall and distributes horizontal cracking, if any, between the load-bearing ends of the wall (or, if the composite reinforcement layer does not extend between the load-bearing ends of the wall, then between the upper and lower ends of the composite reinforcement layer). Accordingly, where the warp and fill yarns of the preferred fabric extend substantially horizontally and vertically, respectively, across the face of a wall, it is preferred that the warp yarns be formed from the group of materials including (E-type and other high strength) glass, polyaramid, graphite, silica, quartz, carbon, ceramic, (ultra-high molecular weight) polyethylene, polyimide, liquid crystal polymers and polypropylene fibers and that the fill yarns be formed from the group of materials including polyester and nylon fibers.

The diameters of such high strength fibers preferably range from about 3 microns to about 30 microns. The diameters of the lower strength, higher elongation fibers preferably range from about 0.5 to about 10 deniers per fiber. It is preferred that each warp yarn include between 2 and 8000 fibers and that each fill yarn include between about 1 and 2000 fibers. The number of warp yarns per inch is preferably between about 5 to 20. The preferred number of fill yarns per inch is preferably between about 0.5 and 5.0.

Figure 10:
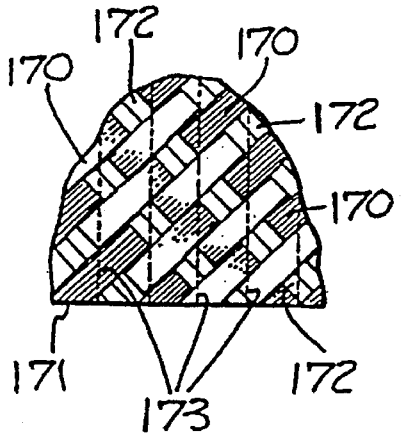
FIG. 10 depicts a weave pattern which is the same as the weave pattern shown in FIG. 9 except that the yarns are stitch bonded together.

It is preferred that the fabric weave patterns be held securely in place relative to each other. This is preferably accomplished by the stitch bonding of the yarns together as shown at FIG. 10. An alternative method of holding the yarns in place is by the use of an adhesive or lenoweaving process, both are of which are well known to those skilled in the art. In FIG. 10, exemplary yarns used to provide the stitch bonding are shown in phantom at 173. The process by which the yarns are stitched bonded together is conventional and will not be described in detail. The smaller yarn used to provide the stitch bonding may be made from the same materials as the principal yarns or from any other suitable material commonly used to stitch bond fabric yarns together. The fabric shown in FIG. 8 may be stitched bonded.

Figure 12:
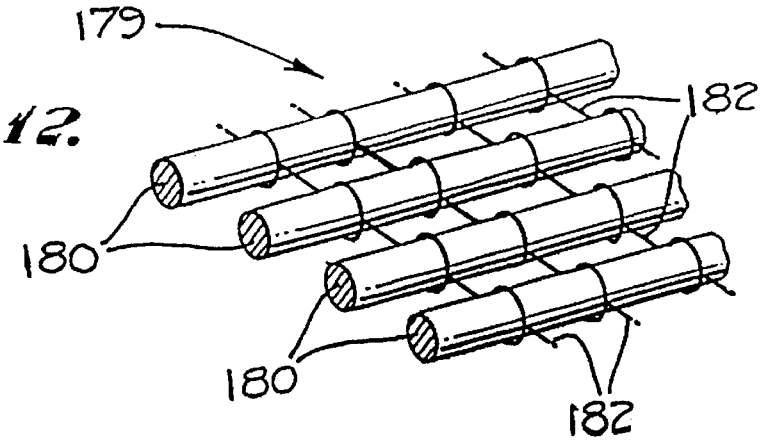
FIG. 12 depicts unidirectional fabric which is stitch bonded and may be used as a fabric layer in accordance with the present invention.

Also, if desired, a unidirectional fabric which is stitched bonded may be used in accordance with the present invention. Such a unidirectional stitch bonded fabric is shown in FIG. 12 at 179. The fabric includes unidirectional fibers 180 which are stitch bonded together as represented by lines 182.

Figure 13:
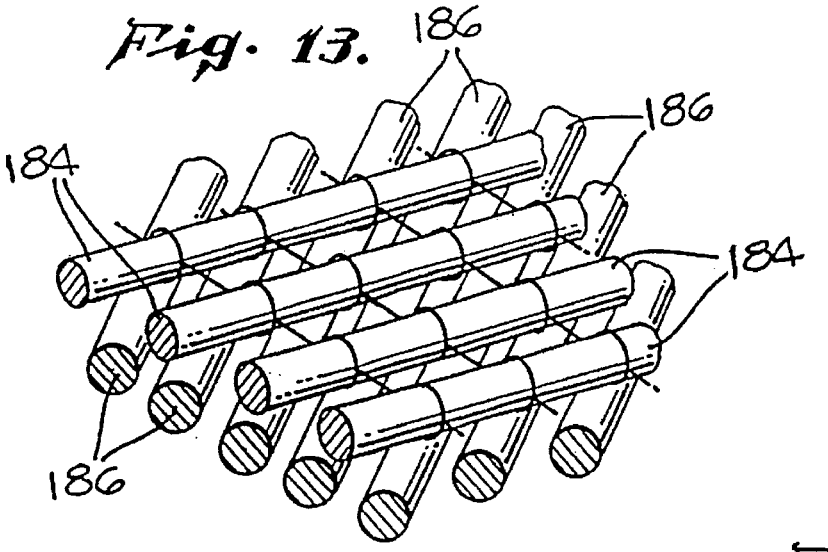
FIG. 13 depicts the unidirectional stitch bonded fabric of FIG. 12 in combination with a second layer of diagonally oriented unidirectionally oriented fabric.

The unidirectional stitch bonded fabric may be used alone or in combination with other fabric configurations. For example, a two layer fabric system is shown in FIG. 13 for an upper unidirectional stitch bonded layer 184 which is the same as the fabric layer 179 is combined with a diagonally oriented lower layer of unidirectional fibers 186. The lower fabric layer may or may not be stitch bonded. The fabric layer 186 as shown in FIG. 13 is not stitch bonded.

Figure 14:
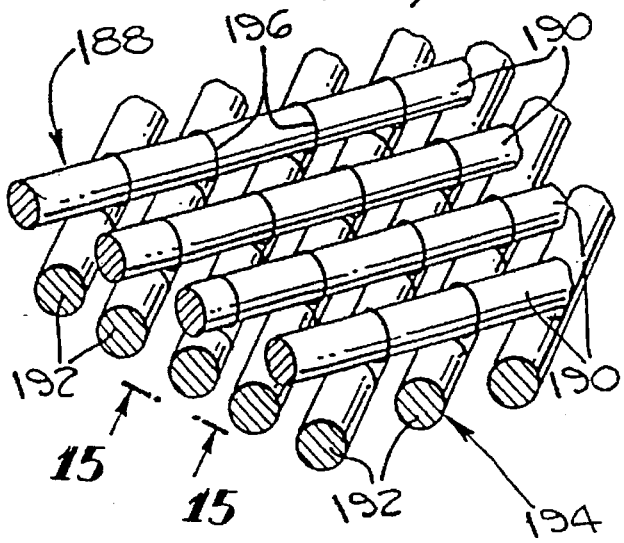
FIG. 14 depicts an alternative fabric layer arrangement wherein two diagonally oriented units directional fabrics are stitch bonded together.
Figure 15:
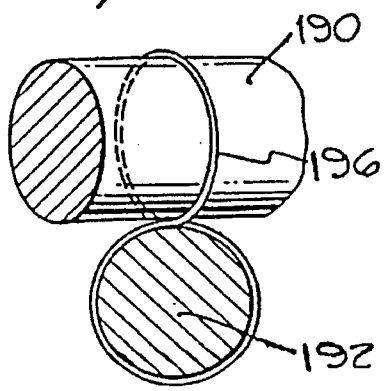
FIG. 15 is a sectional view of FIG. 14 taken in the 15—15 plane.

Another alternative fabric layer embodiment is shown in FIGS. 14 and 15. In this embodiment, the upper layer 188 is a unidirectional fabric in which the fibers 190 are not stitch bonded together. Instead the fibers are stitch bonded to the fibers 192 of the lower layers as represented by lines 196.

Figure 11:
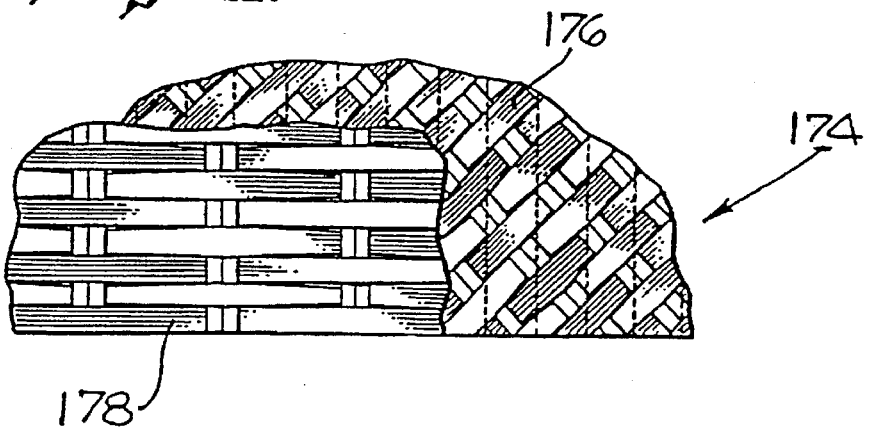
FIG. 11 is a detailed partial section of the face of a reinforced wall covered with multiple fabric layers.

In FIG. 11, a portion of a composite reinforcement layer is shown generally at 174. The composite reinforcement layer includes an interior fabric layer which is the same as the fabric layer 176 shown in FIG. 10. In addition, an exterior fabric layer 178 is provided which is the same as the fabric layer as shown in FIG. 8. This dual fabric layer composite reinforcement provides added structural strength when desired.

The ability of a fabric reinforced wall to withstand atypical loading such as is encountered during earthquakes can be further enhanced by injecting a hardenable material between the composite reinforcement layer and the wall face after the resin in the composite reinforcement layer is substantially cured. The hardenable material preferably has low-shrink characteristics such that, upon injection and hardening, the pressure between the composite reinforcement layer and the wall face is increased. Where this technique is used, it is preferable, but not essential, to place an inflatable bladder between the composite reinforcement layer and the wall to be used as a housing for the hardenable, low shrink material. A more detailed discussion of this method is disclosed in U.S. Pat. No. 5,043,033 describe above.

A method is thus disclosed for increasing the ductility and strength of a walls in situ without removing the walls from service and without the need to provide auxiliary support during the repair process.

Although the present invention has thus been described in detail with regard to the preferred embodiments and drawings thereof, it should be apparent to those skilled in the art that various adaptations and modifications of the present invention may be accomplished without departing from the spirit and the scope of the invention. Thus, by way of example and not of limitation, conventional metal or high strength plastic fasteners may be used to anchor a composite reinforcement layer to a structural member of a wall to be reinforced.

Those skilled in the art will also understand that it is generally preferable to reinforce the obverse face of a wall where structurally feasible and economically practicable. Accordingly, it is to be understood that the detailed description and the accompanying drawings as set forth hereinabove are not intended to limit the breadth of the present invention, which should be inferred only from the following claims and their appropriately construed legal equivalents, rather than from the examples given.

What is claimed is:

1. A reinforced wall comprising:

a wall having at least one face;

a reinforcement layer overlaying at least a portion of said face, said reinforcement layer comprising at least one fabric layer impregnated with resin; and a fastener comprising a fabric member which extends through said face into or through said wall for anchoring said reinforcement layer to said wall.

2. A reinforced wall according to claim 1 wherein said fabric member comprises a fabric strap.

3. A reinforced wall according to claim 1 wherein said fabric member is partially or totally impregnated with resin.

4. A reinforced wall according to claim 1 wherein said fabric member is partially or totally impregnated with an adhesive.

5. A reinforced wall according to claim 1 wherein said fastener further comprises an anchor retention device such as a pin or plug which cooperates with said fabric member so as to hold said fabric member in a fixed position relative to said wall.

6. A reinforced wall according to claim 1 wherein said composite reinforcement layer includes a plurality of high strength substantially horizontally extending yarns and a plurality of lower strength higher elongation substantially vertically extending yarns to allow for greater elongation along the vertical reinforcement direction.

7. A reinforced wall according to claim 6 wherein said high strength yarns are comprised of fibers selected from the group of materials including glass, polyaramid, graphite, silica, quartz, carbon, ceramic, polyethylene, polyimide, liquid crystal polymers and polypropylene and said lower strength higher elongation yarns are comprised of fibers selected from the group of materials including polyester and nylon.

8. A reinforced wall according to claim 1 wherein said composite reinforcement layer includes an intumescent intermixed within the resin, the intumescent being suitable for rendering said composite reinforcement layer fire resistant.

9. A reinforced wall according to claim 1, the wall further having an obverse side opposite said face, the wall having an anchor receiving cavity extending from said face to said obverse side, the wall further comprising:

a member abutting said obverse side, wherein said fastener attaches said reinforcement layer to said member through said anchor receiving cavity.

10. A reinforced wall according to claim 9 wherein said member comprises an anchor pin.

11. A reinforced wall according to claim 9 wherein:

said member has a hole therethrough;

said fastener has a first end, a middle portion, and a second end;

said fastener first and second ends are affixed to said reinforcement layer; and said fastener middle portion extends into said anchor receiving cavity and through said hole.

12. A reinforced wall according to claim 1 wherein said composite reinforcement layer includes a low temperature melting glass intermixed within the resin, the low temperature melting glass being suitable for rendering the composite reinforcement layer fire resistant.

13. A reinforced wall according to claim 1, the wall further having an obverse side opposite said face, wherein:

said wall has first and second anchor receiving cavities spaced apart and extending from said face of wall to said obverse side;

said fastener comprises a fabric strap having first and second ends and a middle portion therebetween; and said first and second fabric strap ends are affixed to said reinforcement layer, said fabric strap middle portion passing from said face to said obverse side through the first anchor receiving cavity and back to said face through the second anchor receiving cavity.

14. A method for reinforcing walls comprising the steps of:

applying a fabric layer over a portion of a face of a wall;

impregnating said fabric layer with a curable resin to form a resin-impregnated fabric layer;

affixing an anchor comprising a fabric member into or through said wall; and affixing said anchor to said reinforcement layer.

15. A method of reinforcing walls according to claim 14 further comprising the step of intermixing said resin with an intumescent suitable for rendering said composite reinforcement layer fire resistant.

16. A method of reinforcing walls according to claim 14 further comprising the step of intermixing said resin with a low temperature melting glass suitable for rendering said composite reinforcement layer fire resistant.

17. The method of claim 14 wherein the step of affixing an anchor into or through said wall comprises the substeps of:

providing an anchor receiving cavity within said wall; and affixing said fabric member within said anchor receiving cavity.

18. The method of claim 17 wherein the substep of affixing said fabric member within said anchor receiving cavity comprises the substep of:

impregnating said fabric member with an adhesive, so as to adhere said fabric member to the inner surface of said anchor receiving cavity.

19. The method of claim 18 wherein the substep of affixing said fabric member within said anchor receiving cavity further comprises the substep of:

inserting a pin or plug into said anchor receiving cavity, the pin or plug cooperating with said fabric member so as to hold said fabric member in a fixed position relative to said wall.

20. The method of claim 17 wherein the substep of affixing said fabric member within said anchor receiving cavity comprises the substep of:

providing a member abutting the side of the wall obverse from said reinforcement layer; and attaching said fabric member to said member abutting the obverse side of the wall.

* * * * *